United States Patent [19]

Jaeschke

[11] 4,305,259

[45] Dec. 15, 1981

[54] FROST SENSOR EMPLOYING SELF-HEATING THERMISTOR AS SENSOR ELEMENT

[75] Inventor: James R. Jaeschke, Waukesha, Wis.

[73] Assignee: Eaton Corporation, Cleveland, Ohio

[21] Appl. No.: 136,846

[22] Filed: Apr. 3, 1980

[51] Int. Cl.[3] ..... F25D 21/02

[52] U.S. Cl. ..... 62/140; 62/155; 62/158

[58] Field of Search ..... 62/140, 156, 155, 158, 62/231; 340/580

[56] References Cited

U.S. PATENT DOCUMENTS

| | | | |
|---|---|---|---|
| 3,248,892 | 5/1966 | Sutton et al. | 62/156 |
| 3,418,531 | 12/1968 | Strachan . | |
| 3,474,638 | 10/1969 | Dodge | 62/153 |
| 3,514,966 | 6/1970 | Kusuda et al. | 62/155 X |
| 3,578,754 | 5/1971 | Kusuda et al. | 62/156 |
| 3,894,404 | 7/1975 | Stanton | 62/156 |

OTHER PUBLICATIONS

Thermistor Manual; Fenwal Electronics, 1974.

*Primary Examiner*—William E. Wayner
*Attorney, Agent, or Firm*—R. J. McCloskey; M. L. Union

[57] ABSTRACT

A frost sensor circuit which employs a thermistor (10, 20) to sense the amount of frost present on the cooling coils of a refrigerator, air conditioner, or the like, and to inhibit defrosting that would otherwise occur at regular intervals, in those cases where the frost present is not enough to justify a defrost function thereby to limit defrost heating to those cycles requiring it, thus saving electrical energy. This is done by mounting the thermistor at or on the coils to collect the same amount of frost as the coils and to have the defrost cycle control (11) energize the same for a timed interval, melting the frost thereon and thereby determining the amount of frost build-up.

22 Claims, 4 Drawing Figures

Fig. 1
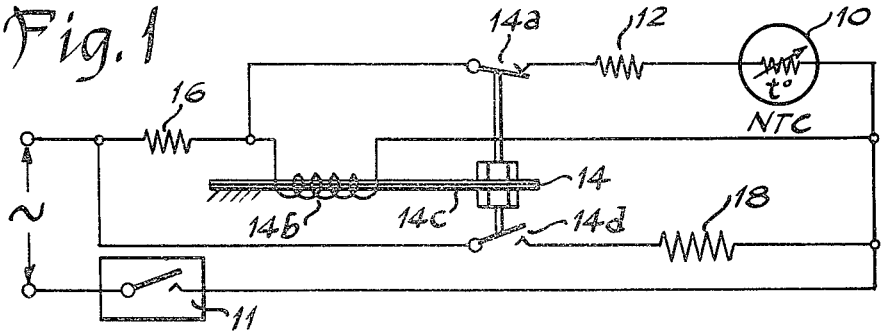
Fig. 2
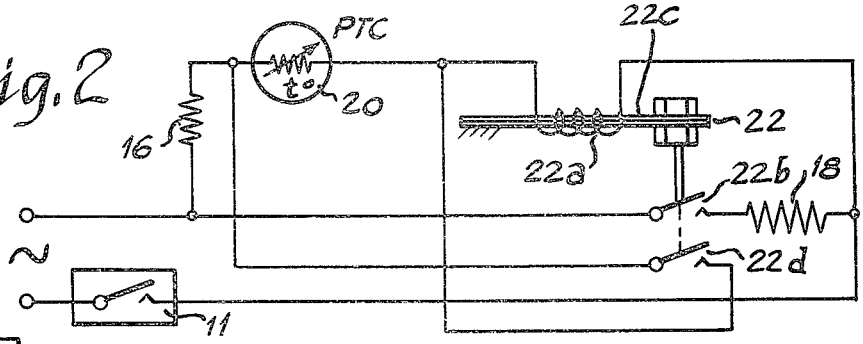
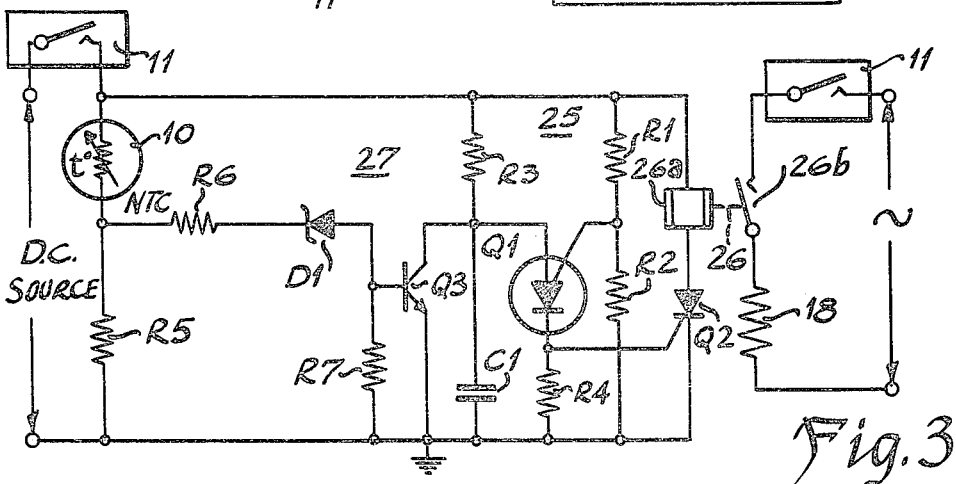
Fig. 3
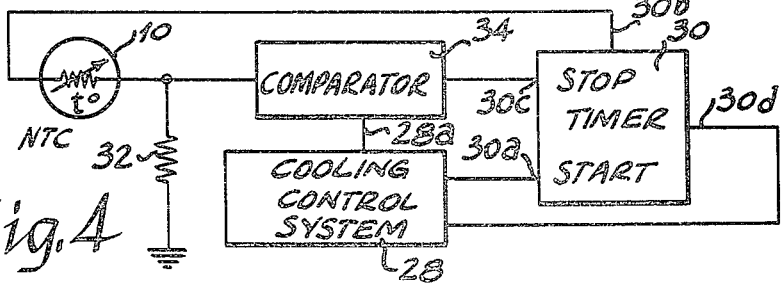
Fig. 4

FROST SENSOR EMPLOYING SELF-HEATING THERMISTOR AS SENSOR ELEMENT

BACKGROUND OF THE INVENTION

This invention relates to refrigeration or cooling controls, and in particular to frost sensors in those controls which employ thermistors as frost sensors elements.

Frost build-up on the cooling coils of a refrigerator or heat pump is one of the major causes of loss of efficiency and energy waste in these devices. It has thus become common for these devices to include defrosting means, including controls which energize these defrosting means in regular intervals. If for some reason, however, frost has not built up to the extent requiring defrosting, the defrost means energizes anyway, wasting more energy. A further control is therefore needed to determine whether sufficient frost is present to require a defrost cycle.

The use of a thermistor simply as a temperature sensor is well known. For example, Kusuda, U.S. Pat. No. 3,578,754, issued May 18, 1971, discloses a defrosting controller for electric refrigerators which employs a thermistor as a temperature sensor. Similarly, Sutton U.S. Pat. No. 3,248,892, issued May 3, 1976, employs a thermistor as a frost sensor, in that when the temperature of the thermistor decreases sufficiently, due to its being covered by frost, a defrost element is activated. This design has the disadvantage, however, that the thermistor is continuously energized in order to continuously sense the amount of frost. The thermistor sensor is thus continuously conducting current, resulting in an increase in the temperature of the thermistor and a distortion of its indication of frost. Therefore, a more accurate circuit for sensing frost is needed.

SUMMARY OF THE INVENTION

This invention involves an addition to the control circuit of a refrigeration or heat pump system having a defrost cycle control which energizes at predetermined intervals. It includes a thermistor and a timing circuit, which are connected to the defrost cycle control of the system and which control the defrost means, usually a resistive heater. The thermistor is held at the same temperature as the cooling coils, and thus gathers frost similarly. When the defrost cycle control energizes, current passes through the thermistor, increasing its temperature and melting any frost accumulated on it. At the same time, the timing circuit is energized. If the frost on the thermistor is melted before the end of the interval measured by the timing circuit, the defrost heater will not be turned on during the defrost cycle. If the measured time interval ends before the thermistor melts the frost accumulated on it, a defrost cycle is warranted, and hence is begun immediately. The result is a frost sampling circuit which samples the amount of frost present on the cooling coils, and if the frost is less than a predetermined amount, the defrost cycle control is inhibited from energizing the defrost heater.

An object of this invention is to provide a frost sampling means for a cooling system having a defrost means which is turned on at predetermined intervals, the function of the frost sensor being to inhibit the defrost cycle if the amount of frost is insufficient to warrant a defrost cycle.

Another object of this invention is to provide a frost sensor including a thermistor as a sensor element.

Further objects and advantages of the instant invention will become obvious or will be stated hereinafter.

DESCRIPTION OF THE DRAWING

FIG. 1 is a diagrammatic view of a circuit embodying this invention.

FIG. 2 is a view of an alternate embodiment of this invention.

FIG. 3 is a diagram of an electronic alternative embodiment of this invention.

FIG. 4 is a view of a further alternate embodiment of the invention.

DESCRIPTION OF THE PREFERRED EMBODIMENT

Referring to FIG. 1, the invention includes a negative temperature coefficient (NTC) thermistor 10, meaning that its resistance decreases with an increase in temperature. This thermistor is physically attached to or secured near the cooling coils of a refrigerator or other cooling system, such that frost accumulates on it at about the same rate as on the coils themselves. In the frost sensor circuit, thermistor 10 is connected in series with current limiting resistors 12 and 16 and the normally closed (N.C.) contacts **14*a* of a bimetal relay 14 across an A.C. source and a defrost cycle control 11, which already exists in most self-defrosting cooling systems. Relay 14 includes a resistive heater 14*b* on a bimetallic element 14*c* of an over-center contact assembly having one set of N.C. contacts 14*a* and one set of normally open (N.O.) contacts 14*d*. The resistor heater 14*b* is connected in parallel with N.C. contacts 14*a*, resistor 12 and thermistor 10, and in series with another current limiting resistor 16 across the A.C. source. The defrost heater 18 already existing in the cooling system is connected, through N.O. contacts 14*d*, in parallel with the rest of the components already listed, directly across the A.C. source as shown in FIG. 1**.

In operation, this defrost cycle control 11 normally directly energizes the defrost heater on the refrigeration coils after a predetermined interval, such as once every 24 hours, regardless of the amount of frost present, so that any frost that is present is melted away. In this circuit, however, the same signal is employed to energize the frost sensor. Thus when the A.C. line voltage is applied to the device, current initially passes through both the thermistor 10 and the bimetallic heater element **14*b*, increasing the temperature of both. Of course the temperature of thermistor 10** increases more slowly if frost is present on it.

If the bimetallic element **14*c* warms up faster than the thermistor 10, the trip point of the over-center mechanism will be reached, causing N.C. contacts 14*a* to open and N.O. contacts 14*d* to close. Hence, since the requisite amount of frost was determined to be present on thermistor 10, the circuit having the thermistor is deenergized and the circuit having the defrost heater 18 is energized, so that the cooling coils are defrosted. Then at the end of the normal defrost cycle, the bimetal heater 14*b* is deenergized and the relay 14 returns to its original position as shown in FIG. 1** until the next defrost cycle.

If on the other hand thermistor 10 warms up faster than bimetal heater **14*b*, as would be the case if there were little or no frost on the thermistor, it will draw current away from the bimetal heater circuit. The trip point of the overcenter mechanism will not then be reached, and defrost heater 18** will not be energized.

Thus when insufficient frost is present on the cooling coils of the system, and a defrost operation is not necessary, the defrost heater is not energized.

For ease of understanding the several figures of the drawings, the same reference numerals are used to refer to elements which appear in more than one figure.

Illustrated in FIG. 2 is an alternative embodiment. This circuit employs a positive temperature coefficient (PTC) thermistor 20, meaning that its resistance increases with an increase in temperature. Thermistor 20 is positioned within the cooling system such that frost accumulates on it at about the same rate as on the coils of the cooling system. The circuit also includes a bimetal relay 22, which has a bimetal heater element 22*a*, a bimetallic element 22*c* and two sets of N.O. contacts 22*b* and 22*d*. Heater element 22*a* is connected in series with thermistor 20. One set of contacts 22*b* is connected in series with defrost heater 18, while the other set 22*d* shunts thermistor 20.

The operation of this circuit can be described as follows: When A.C. line voltage is applied to the circuit by the defrost cycle control 11, current flows through thermistor 20 and bimetal heater element 22*a*, heating up both components. Again, thermistor 20 will heat up more slowly if frost has accumulated on it. If the bimetallic element 22*c* then warms up faster than thermistor 20, the trip point of the overcenter mechanism will again be reached. The relay contacts 22*b* will then close, energizing the defrost heater 18, since sufficient frost will have been detected to justify a defrost cycle. Relay contacts 22*d* also close, effectively shorting thermistor 20 and removing it from the circuit. The thermistor is shorted out to insure that enough current reaches bimetal heater element 22*a* so that contacts 22*b* remain closed until the end of the entire defrost cycle. At that time the circuit is deenergized and both sets of contacts 22*b* and 22*d* return to the open position as shown in FIG. 2.

If thermistor 20 warms up faster, on the other hand, as would be the case if there were little or no frost on it, its resistance would increase such that less current is allowed to reach bimetal heater 22*a*. Thus the trip point of the over-center mechanism would not be reached. Therefore since insufficient frost was present to justify a defrost cycle, defrost heater 18 would not be energized.

In place of N.O. contacts 22*d* and the circuit which shunts thermistor 20, a fixed value resistor could be connected in parallel with thermistor 20 in order to allow sufficient current to reach bimetal heater element 22*a* to keep contacts 22*b* closed until the end of the defrost cycle. This arrangement would be more economical but less efficient than the shorting circuit shown in FIG. 2.

FIG. 3 shows another variation of the circuit shown in FIG. 1, wherein an electronic timer circuit 25 and electromagnetic relay 26 are substituted for the bimetallic relay 14 of FIG. 1. The timer circuit 25 includes a programmable unijunction transistor (PUT) Q1 which has three terminals, a gate, a cathode and an anode. The gate is connected to the junction between two series resistors R1 and R2 which set a trigger voltage for the PUT, since they are connected between a D.C. source voltage and ground. Connected in parallel with R1 and R2 are a resistor R3 and a capacitor C1 connected in series. The anode of Q1 is connected to the junction between resistor R3 and capacitor C1. The cathode of PUT Q1 is connected to ground through resistor R4, and directly to the gate of a silicon-controlled rectifier (SCR) Q2. The main terminals of SCR Q2 connect the coil 26*a* of relay 26 to ground. The contacts 26*b* of relay 26 are connected in series with defrost heater 18, to connect it to a source of A.C. voltage when they close.

In addition, this variation has a timer disabling circuit 27 connected between the thermistor 10 and the timer circuit 25. This disabling circuit 27 includes a resistor R5 connected in series with thermistor 10 to form a voltage divider. The junction between resistor R5 and thermistor 10 is connected in series to a resistor R6, a zener diode D1 and another resistor R7, which is connected to ground. Finally, the base of a transistor Q3 is connected to the junction between the anode of diode D1 and resistor R7, while the emitter is connected to ground and the collector is connected to the junction between resistor R3 and capacitor C1.

When the D.C. voltage is applied to the circuit by the defrost cycle control 11, current begins to flow through thermistor 10, increasing its temperature. In addition, the gate voltage of PUT Q1 is set by resistors R1 and R2, and capacitor C1 begins to charge. If little or no frost is present on thermistor 10, it will warm up relatively quickly. Since it is an NTC thermistor, its resistance will then drop, causing an increasing amount of the D.C. voltage to appear across R5 and across zener diode D1. When the voltage across diode D1 reaches the zener voltage, current is passed into the base of transistor Q3, turning it "ON". Capacitor C1 is thus shorted to ground and discharged through transistor Q3, disabling timing circuit 25 from energizing relay 26.

If sufficient frost is present on thermistor 10, its resistance does not decline as fast. In that case, the voltage across capacitor C1, which is also the anode voltage of PUT Q1, reaches the gate voltage of PUT Q1 before the voltage across R5 reaches the zener voltage of diode D1. The PUT Q1 is then gated "ON" allowing a pulse of current from capacitor C1 through it and into the gate of SCR Q2. This gates the SCR "ON" and energizes coil 26*a* of relay 26, closing contacts 26*b*, and energizing the defrost heater 18.

Thus if little or no frost is present on the thermistor, the defrost heater will not be energized. If somewhat more frost is present, however, the defrost heater will be energized to clear the coils of frost. The exact amount of frost necessary is determined by the values of the various components.

To construct a PTC version of the circuit shown in FIG. 3, a fixed value resistor is connected in the circuit in place of NTC thermistor 10, and a PTC thermistor similar to thermistor 20 of FIG. 2 is substituted for resistor R5. Of course the PTC thermistor is placed such that substantially the same amount of frost accumulates on the thermistor as on the cooling coils, and the circuit then functions in a manner similar to that described above for the circuit shown in FIG. 3.

In FIG. 4 is illustrated another variation of the invention. This alternative could be a part of a complete refrigerator or heat pump control system. It measures the amount of frost accumulated on thermistor 10 so that the defrost heater can be run for only the length of time necessary to melt that amount of frost.

The circuit includes a cooling control system 28, which is connected to the START input 30*a* of a digital or analog timer 30. One output 30*b* supplies voltage from cooling control system 28 to a voltage divider made up of NTC thermistor 10 and a resistor 32 which is connected to ground. The junction between thermistor 10 and resistor 32 is connected to a comparator 34, which is in turn connected to the STOP input 30*c* of timer 30. The other output 30*d* of timer 30 is connected back to cooling control system 28.

The frost measurement cycle begins when cooling control system 28 energizes the circuit. At that point timer 30 is started, and current begins to flow from timer output 30*b* through thermistor 10 and resistor 28. As thermistor 10 warms up, its resistance begins to fall. When this falling resistance causes the voltage across resistor 32 to reach a threshold predetermined by control system output 28*a*, comparator 34 stops timer 30. Output 30*d* of timer 30, in the form of a digital word or a voltage, is then fed back into cooling control system 28. The value of this output represents the amount of frost which was present on the thermistor. System 28 then uses this information to determine the length of time the defrost heater is to be energized in order to clear the cooling coils of frost.

A PTC version of this circuit is constructed by substituting a fixed value resistor for NTC thermistor 10 and replacing resistor 32 with a PTC thermistor similar to thermistor 20 of FIG. 2. The circuit then functions in a manner similar to that described above.

While the circuits hereinbefore described are effectively adapted to fulfill the aforesaid objects, it is to be understood that the invention is not intended to be confined to the particular preferred embodiments herein set forth, inasmuch as they are susceptible of various modifications without departing from the scope of the appended claims.

What is claimed is:

1. In a cooling system having cooling coils, a defrost heater for defrosting said coils, and a defrost cycle control for periodically energizing said defrost heater from an electric source to defrost said coils, a frost sensor circuit comprising:

impedance means, the value of which changes according to its temperature, located so as to collect substantially the same amount of frost as said cooling coils; and a timing circuit, including switching means for energizing said defrost heater at the end of the time interval measured by said circuit, connected with said impedance means in circuit with said defrost cycle control and said defrost heater;

such that if sufficient frost is present on said coils to justify a defrost cycle, said switching means energizes said defrost heater after said time interval measured by said timing circuit, whereas if insufficient frost is present, said impedance causes disabling of said timing circuit to prevent energizing said defrost heater.

2. A frost sensor circuit as recited in claim 1 wherein said timing circuit comprises a bimetal relay having at least one set of normally open contacts, a bimetallic strip for closing said contacts, and means for heating said strip when said timing circuit is energized by said defrost cycle control.

3. A frost sensor circuit as recited in claim 2 wherein said impedance means comprises a thermistor the resistance of which decreases as its temperature increases.

4. A frost sensor circuit as recited in claim 3 wherein said bimetal relay further comprises a set of normally closed contacts in circuit with said thermistor; and wherein said heating means for said bimetallic strip is an electric heating means connected in parallel with said thermistor;

such that when insufficient frost is present on said thermistor to justify a defrost cycle, its resistance decreases as its temperature increases, allowing it to shunt more current from said heating means and allowing insufficient current to pass through said heating means to open said normally closed contacts and close said normally open contacts.

5. A frost sensor circuit as recited in claim 2 wherein said impedance comprises a thermistor the resistance of which increases as its temperature increases.

6. A frost sensor circuit as recited in claim 5 further comprising shorting means in parallel with said thermistor; and wherein said heating means for said bimetallic strip is an electric heating means connected in series with said thermistor;

such that if insufficient frost is present on said thermistor to justify a defrost cycle, its resistance increases sufficiently rapidly to prevent current from passing through itself and said heating means sufficient to close said normally open contacts, whereas if sufficient frost is present the thermistor's resistance increases more slowly allowing sufficient current through said heating means to close said normally open contacts, with sufficient current passing through said shorting means to maintain said contacts in a closed position until the end of the defrost cycle.

7. A frost sensor circuit as recited in claim 6 wherein said shorting means includes a second set of normally open contacts in said bimetal relay, such that when said second set of contacts is closed, said thermistor is effectively shorted out of said circuit.

8. A frost sensor circuit as recited in claim 6 wherein said shorting means comprises a resistor connected in parallel with said thermistor.

9. A frost sensor circuit as recited in claim 1 wherein said switching means includes control means and contact means, said contact means being connected in series with said defrost heater for energizing said defrost heater when said contact means are closed by said control means.

10. A frost sensor circuit as recited in claim 9 wherein said timing circuit also includes first semiconductor switching means having a gate terminal, a cathode terminal and an anode terminal, said cathode and anode terminals being connected in series with said control means of said switching means;

second semiconductor switching means, also having gate, cathode and anode terminals, said cathode terminal being connected to said gate terminal of said first semiconductor switching means;

a D.C. voltage source supplied by said defrost cycle control for supplying electrical power to said frost sensor circuit;

voltage divider means, connected between said D.C. voltage source and ground, for supplying a constant voltage to said gate terminal of said second semiconductor switching means;

a resistor and capacitor connected in series between said D.C. voltage source and ground, with said anode of said second semiconductor switching means connected to the junction between said resistor and capacitor, such that when the voltage across said capacitor reaches the voltage supplied to said gate terminal, said capacitor sends a pulse of current through said second semiconductor switching means into said gate terminal of said first semiconductor switching means, energizing said control means, which closes said contact means to energize said defrost heater.

11. A frost sensor circuit as recited in claim 10 wherein said impedance comprises a thermistor the resistance of which decreases as its temperature increases.

12. A frost sensor circuit as recited in claim 11 further comprising timing circuit disabling means which, in combination with said thermistor, prevents said timing circuit from energizing said defrost heater when the frost present on said thermistor is less than a predetermined amount of frost necessary to justify a defrost cycle.

13. A frost sensor circuit as recited in claim 12 wherein said disabling means comprises a resistor in series with said thermistor, the two being connected across said D.C. source to form a voltage divider, the voltage output of which is the voltage across said resistor;

a zener diode having a cathode and an anode, the cathode of which is connected to the junction between said resistor and thermistor and the anode of which is connected through a second resistor to ground; and a transistor having a base, collector and emitter, the base of which is connected to the junction between said anode of said diode and said second resistor, while the collector and emitter connect the anode of said second semiconductor switching means to ground;

such that if said thermistor reaches a predetermined temperature and thus resistance before the end of the time interval measured by said timing circuit, as will be the case if insufficient frost is present on said thermistor to justify a defrost cycle, said capacitor is discharged through said transistor rather than through said second semiconductor switching means, disabling said timing circuit from energizing said defrost heater.

14. A frost sensor circuit as recited in claim 10 wherein said impedance comprises a thermistor the resistance of which increases as its temperature increases.

15. A frost sensor circuit as recited in claim 14 further comprising timing circuit disabling means which, in combination with said thermistor, prevents said timing circuit from energizing said defrost heater when the frost present on said thermistor is less than a predetermined amount of frost necessary to justify a defrost cycle.

16. A frost sensor circuit as recited in claim 15 wherein said disabling means comprises:

a resistor in series with said thermistor, the two being connected across said D.C. source to form a voltage divider, the voltage output of which is the voltage across said thermistor, a zener diode having a cathode and an anode, the cathode of which is connected to the junction between said thermistor and resistor, and the anode of which is connected through a second resistor to ground; and a transistor having a base, collector and emitter, the base of which is connected to the junction between said anode of said diode and said second resistor, while the collector and emitter connect the anode of said second semiconductor switching means to ground;

such that if said thermistor reaches a predetermined temperature and thus resistance before the end of the time interval measured by said timing circuit, as will be the case if insufficient frost is present on said thermistor to justify a defrost cycle, said capacitor is discharged through said transistor rather than through said second semiconductor switching means, disabling said timing circuit from energizing said defrost heater.

17. In a cooling system having cooling coils, defrost means for defrosting said coils, and a cooling control system for controlling said coils and defrost means, a frost sensor comprising:

a timer having "START" and "STOP" inputs, said "START" input being connected to said control system;

first and second impedance means, in series between said timer and ground, one of said impedance means being located so as to accumulate substantially the same amount of frost as said cooling coils, the value of said one of said impedance means varying according to its temperature; and comparator means for comparing the voltage at the junction between said first and second impedances with a predetermined voltage supplied by said control system, and for energizing said "STOP" input of said timer when said junction voltage reaches said predetermined voltage;

such that said "START" input is energized at the same time as current begins to flow from said timer output through said first impedance, the heat from said current melting any frost accumulated on said impedance, and when that frost is melted said comparator energizing said "STOP" input of said timer, which in turn indicates to said control system the amount of time necessary for said defrost means to be energized in order to defrost said cooling coils.

18. A frost sensor as recited in claim 17 wherein said one of said impedance means is said first impedance means, which is a thermistor the resistance of which decreases as its temperature increases.

19. A frost sensor as recited in claim 17 wherein said one of said impedance means is said second impedance means, which is a thermistor the resistance of which increases as its temperature increases.

20. In a cooling system having cooling coils, a defrost heater for defrosting said coils, and a defrost cycle control operable to normally periodically energize said defrost heater, means for inhibiting defrosting when frost accumulation is insufficient to require it, thereby to save energy, comprising:

frost sampling means, located so as to accumulate substantially the same amount of frost as is accumulated on said cooling coils, and responsive to the operation of said defrost cycle control for sampling said frost; and control means for inhibiting said defrost cycle control from energizing said defrost heater if the amount of frost accumulated on said frost sampling means is less than a predetermined amount.

21. The invention described in claim 20 wherein said frost sampling means includes impedance means, the value of which changes according to its temperature, and the temperature of which increases as current passes through it, melting the frost it has accumulated.

22. The invention described in claim 21 wherein said control means includes a timing circuit for measuring a predetermined time interval, and switching means for inhibiting said defrost cycle control from energizing said defrost heater if said impedance means melts all of said frost before said time interval has expired.

* * * * *